US006139691A

United States Patent [19]

Brox

[11] Patent Number: 6,139,691

[45] Date of Patent: Oct. 31, 2000

[54] SHOE PRESS

[75] Inventor: Erik Brox, Forshaga, Sweden

[73] Assignee: Valmet-Karlstad AB, Karlstad, Sweden

[21] Appl. No.: 09/164,150

[22] Filed: Sep. 30, 1998

Related U.S. Application Data

[60] Provisional application No. 60/069,898, Dec. 17, 1997.

[30] Foreign Application Priority Data

Sep. 30, 1997 [SE] Sweden ..... 9703571
Nov. 19, 1997 [SE] Sweden ..... 9704234

[51] Int. Cl.[7] ..... D21F 3/08

[52] U.S. Cl. ..... 162/358.3; 100/153; 162/361

[58] Field of Search ..... 162/358.3, 358.4, 162/358.5, 361; 100/153, 154; 492/7

[56] References Cited

U.S. PATENT DOCUMENTS

| | | | |
|---|---|---|---|
| 5,620,566 | 4/1997 | Holopainen | 162/358.3 |
| 5,843,283 | 12/1998 | Hennsler et al. | 162/358.3 |
| 5,997,695 | 12/1999 | Ilmarinen | 162/358.3 |
| 5,997,696 | 12/1999 | Gustavsson et al. | 162/358.3 |
| 6,017,422 | 1/2000 | Brox | 162/358.3 |

FOREIGN PATENT DOCUMENTS 0 345 501 12/1989 European Pat. Off. .
19515832C1 5/1996 Germany .

*Primary Examiner*—Karen M. Hastings
*Attorney, Agent, or Firm*—Alston & Bird LLP

[57] ABSTRACT

A shoe press for a paper or board machine, comprising a press shoe, a counter roll and a circulated flexible belt. A plurality of hydraulic loading cylinders for pressing the press shoe against the counter roll are arranged between a horizontal frame beam and the press shoe. The pistons of the loading cylinders are connected to the horizontal beam. The shoe press may have first hydrostatic compartments in the surface of the press shoe facing the counter roll and second hydrostatic compartments arranged between the side of the press shoe facing the loading cylinders and the loading cylinders. For supplying the working chambers of the loading cylinders and/or the first and/or second hydrostatic compartments with hydraulic fluid, there is arranged a duct which extends in the longitudinal direction of the press shoe and is common to all working chambers and the first and second hydrostatic compartments, respectively. The duct for connecting the working chambers is at least partially formed by tubular duct members which are formed separately from the frame of the shoe press and which extend between and fluidly connect adjacent pairs of loading cylinders. In a preferred embodiment, the tubular duct members are slidably inserted in bores formed through the pistons of the loading cylinders, and a seal is disposed between the duct members and the bores for sealing of the joints.

13 Claims, 1 Drawing Sheet

SHOE PRESS

CROSS-REFERENCE TO RELATED APPLICATIONS

This application claims priority to U.S. Provisional Patent Application Ser. No. 60/069,898, filed Dec. 17, 1997.

FIELD OF THE INVENTION

The present invention relates to a shoe press for paper machines, board machines, or the like.

BACKGROUND OF THE INVENTION

Shoe presses generally comprise a press shoe and a counter roll which form an extended nip therebetween through which a running fibrous web is carried for treating the web, such as for dewatering the web in the press section of a paper machine. Shoe presses generally also comprise pressure-actuatable piston-and-cylinder units, also referred to as loading cylinders, which are distributed along the press shoe in one or more rows in the longitudinal direction of the press shoe and adapted to press the press shoe against the counter roll. For example, EP 345 501 B2, DE-195 15 832 C1, and DE-44 09 316 C1 all show shoe presses of the type described above.

Some shoe presses also include compartments arranged in the press shoe surface facing the counter roll, the compartments in operation being supplied with fluid under hydrostatic pressure for lubricating the belt, as shown for example in EP-345 501 B2.

Moreover shoe presses may comprise a pocket or pressure chamber between each loading cylinder and the press shoe, which may be open towards the press shoe and in operation be supplied with fluid under hydrostatic pressure. The pressure chamber acts to transmit the pressure of the loading cylinder to the press shoe and to form a hydraulic fluid pad, as disclosed for example in DE-195 15 832 C1.

These loading cylinders, compartments, and pockets require access to hydraulic fluid. Various designs have been developed for delivering hydraulic fluid to the working chambers of loading cylinders, to hydrostatic compartments in a press shoe surface for belt lubrication, and to hydrostatic pockets between loading cylinders and a press shoe. For example, EP-345 501 B2 discloses a shoe press in which the compartments in the press shoe surface facing the counter roll are pressurized by hydraulic fluid through a main duct which is common to all the compartments and is bored through the frame system of the shoe press in the longitudinal direction (i.e., cross-machine direction) of the shoe press. A plurality of individual ducts bored in the frame connect the main duct to each compartment, each of the individual ducts serves as a throttle. The throttle serves the purpose of making the pressure condition of each compartment essentially independent of the pressure conditions of the other compartments. EP-345 501 B2 also discloses that the loading cylinders are pressurized by hydraulic fluid via additional ducts bored in the frame system of the shoe press.

Similarly, DE-195 15 832 C1 also discloses a shoe press in which ducts are bored in the frame system of the shoe press for supplying hydraulic fluid to the loading cylinders by hydraulic fluid as well as for pressurizing the pressure chambers between the press shoe and the loading cylinders, a cylinder member of each loading cylinder including an opening or throttle for passing fluid from the working chamber of the loading cylinder into the pressure chamber.

The frame system of a shoe press is typically formed of relatively massive members, for example steel beams.

Accordingly, boring ducts through the frame system for supplying hydraulic fluid to the various chambers and compartments is a complicated and expensive procedure. Additionally, the fixed geometry of the ducts does not readily allow for varying the flow characteristics, for example where it is desired to change the relative proportions of flow supplied to various ones of several chambers or compartments.

In addition, shoe presses are subjected to thermal action, for instance owing to the friction between the circulated flexible belt and the press shoe. Different parts of the shoe press, for instance, the press shoe and the frame system, expand at different speeds and to different degrees when subjected to heat, which causes stress and deformation problems as well as jamming of the loading cylinder pistons in the cylinder parts thereof. The problem is exacerbated if the parts of the shoe press are made of different materials, e.g., steel for the frame system and aluminum (alloy) for the press shoe.

SUMMARY OF THE INVENTION

The present invention overcomes the drawbacks associated with prior shoe presses noted above, by providing a shoe press in which hydraulic fluid is supplied to the loading cylinders, compartments, and/or chambers via a common duct which is at least partly comprised by tubular duct members which are formed separately from the frame of the shoe press. Thus, the necessity of forming bores in the frame is avoided.

In accordance with a preferred embodiment of the invention, a shoe press comprises a press shoe having a first side adapted to coact with the counter roll to form an extended nip therebetween through which the running web is carried, a supporting frame spaced from a second side of the press shoe opposite the first side, and a plurality of hydraulic loading cylinders disposed between the frame and the press shoe and operable for pressing the press shoe against the counter roll. Each loading cylinder has a working chamber adapted to be pressurized with hydraulic fluid. The shoe press includes at least one tubular duct member which is formed separately from the supporting frame and which is connected between adjacent loading cylinders so as to form a common duct for supplying fluid to the working chambers of said adjacent loading cylinders.

Preferably, the loading cylinders include receptacles in communication with the working chambers, and the tubular duct members are received by the receptacles. In a further preferred embodiment of the invention, each loading cylinder includes a piston, and the duct is formed in part by a bore through each of the pistons, each bore having opposite open ends forming the receptacles for receiving the tubular duct members.

For connecting the working chamber of each loading cylinder to the common duct, preferably a passage is formed in the piston of each loading cylinder, the passage connecting the working chamber of each loading cylinder to the bore.

In accordance with another preferred embodiment of the invention, opposite ends of each tubular duct member are slidably received in end portions of the piston bores of adjacent loading cylinders. A sealing ring is disposed between an outer surface of each tubular duct member and an inner surface of the end portion of the corresponding piston bore. Thus, the tubular duct members remain sealingly connected to the loading cylinders even if some relative motion occurs between adjacent loading cylinder causing the duct members to slide within the bores.

In a further preferred embodiment, at least one of the tubular duct members includes an inlet adapted to receive hydraulic fluid from a source for supplying hydraulic fluid to the common duct connecting the loading cylinders. Advantageously, the tubular duct member having the inlet comprises a first tubular portion having opposite ends which connect with an adjacent pair of the loading cylinders, and a second tubular portion which is attached to and opens into the first tubular portion so as to form the inlet.

In accordance with still another preferred embodiment of the invention, a shoe press includes a press shoe having hydrostatic compartments formed in at least one of its opposite sides, and ducts formed in the press shoe are connected to the compartments. At least a pair of tubular duct members are attached to a side of the press shoe and connected end-to-end with at least one end portion of at least one of the duct members being slidably received within a bore formed in an adjacent one of the duct members. At least some of the duct members include at least one opening through a side wall thereof, the openings communicating with the ducts in the press shoe for supplying fluid to the compartments. Thus, the duct members essentially form a duct system which is capable of accommodating expansion in the longitudinal direction (i.e., the cross-machine direction) of the press shoe.

BRIEF DESCRIPTION OF THE DRAWINGS

The invention will now be described in more detail with reference to the accompanying drawings, in which.

DETAILED DESCRIPTION OF PREFERRED EMBODIMENTS

Figure 1:
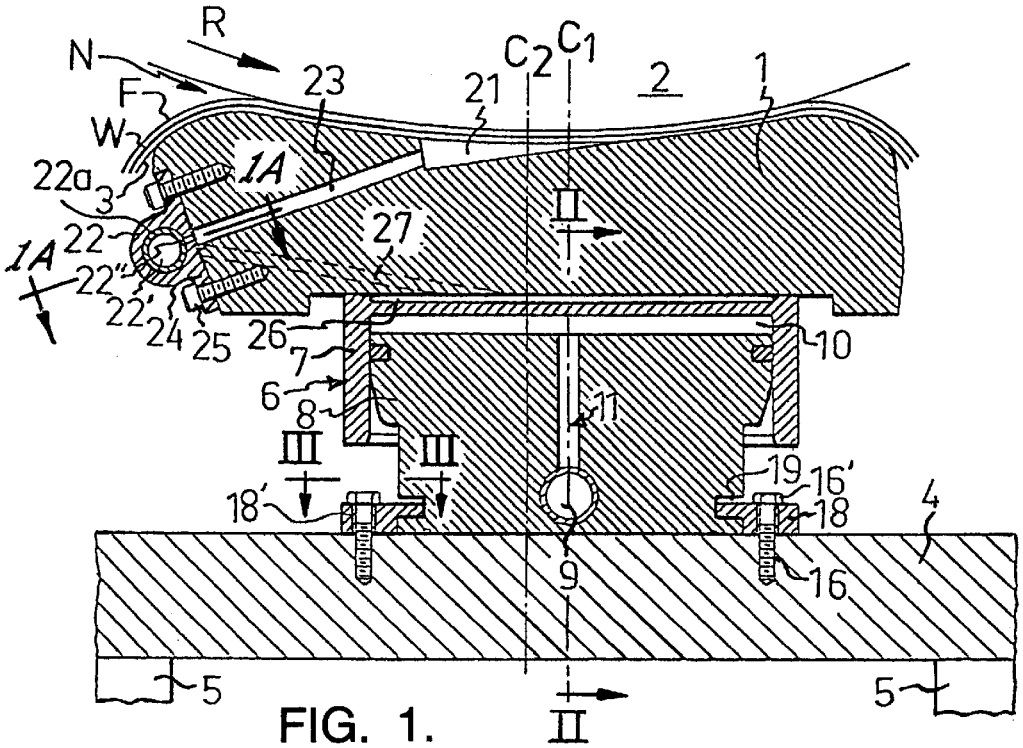
FIG. 1 is a cross-sectional view of a shoe press in accordance with one preferred embodiment of the invention viewed in a cross-machine direction.

The invention is now explained by reference to certain preferred embodiments thereof. It is to be understood, however, that the present invention can be embodied in many different forms and should not be construed as being limited to the embodiments described herein; rather, these embodiments are presented so that this disclosure will be thorough and complete and will fully convey the scope of the invention to those skilled in the art. Like numbers refer to like elements throughout.

It is understood that the press shoe is made in one piece, while there are a plurality of loading cylinders distributed in the longitudinal direction of the press shoe (in the cross-direction of the machine) in a row or in several rows spaced from each other in the machine direction.

The figures illustrate a shoe press for the press section of a paper or board machine, the machine comprising a press shoe 1 and counter roll 2 having the direction of rotation R which between themselves form an extended nip N in which a paper or cardboard web W is carried together with a circulated flexible press belt 3 and one or more press felts F, of which one is shown. A horizontal beam 4 associated with the frame system 5 of the shoe press is spaced from the press shoe 1 on an opposite side thereof from the counter roll 2. The beam 4 supports a number of loading cylinders 6 which are arranged in a row in the longitudinal direction of the shoe press and comprise a cylinder 7 and a piston 8, the latter being attached to the beam 4 in a manner that will be described in more detail below. The press shoe 1 is in this case detachably mounted on the loading cylinder 7. Through and between the pistons 8 runs a horizontal duct 9 extending in the longitudinal direction of the shoe (the cross-direction of the machine) and adapted to supply the working chambers 10 of the loading cylinders with hydraulic fluid, via a vertical duct 11 in each of the pistons 8. Thus, the horizontal duct 9 is common to the working chambers of all the loading cylinders, while each duct 11 connects the common duct 9 to the working chamber of one of the loading cylinders. An O-ring 12 seals between the piston 8 and the cylinder 7.

Figure 2:
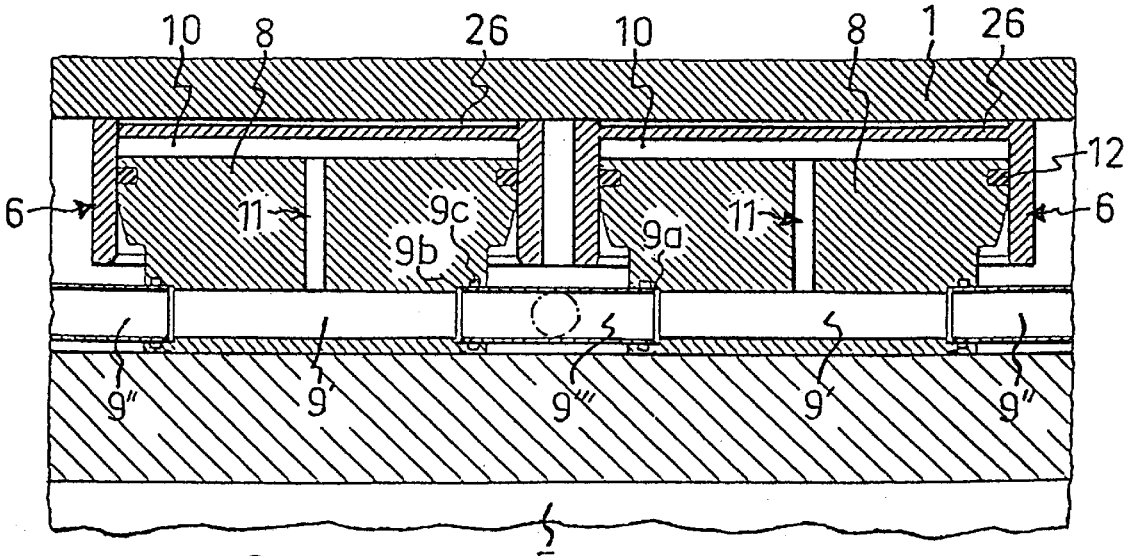
FIG. 2 is a cross-sectional view of the shoe press of FIG. 1 viewed in the machine direction.

As is evident from FIG. 2, the common horizontal duct 9 is formed of bores 9' in the pistons 8 and of tubular duct members 9" extending between the loading cylinders 6 and mutually connecting the piston bores 9'. The duct member 9'" is a T-shaped member having a first tubular portion whose opposite ends are slidably received in the piston bores 9' of the loading cylinders on opposite sides of the duct member 9'", and a second tubular portion indicated by a dash-dotted line which is attached to the first portion and serves to connect the duct 9 to a pressurized hydraulic fluid source (not shown). The ends of each duct member 9" are simply inserted in the piston bores 9 of the loading cylinders on opposite sides of the duct member 9". The piston bores 9 have end portions 9*a* of slightly greater diameter than the middle portions of the bores, such that an abutment 9*b* is formed where each end portion 9*a* meets the smaller-diameter middle portion of the bore. The end portions 9*a* comprise receptacles which slidably receive the ends of the duct members 9". The abutment 9*b* limits the extent to which the duct member 9" can be inserted into the bore 9. Each bore end portion 9*a* includes an O-ring 9*c* which is disposed between the inner surface of the end portion 9*a* and the outer surface of the corresponding duct member 9" for sealing purposes. The slidable sealing connections between the duct members 9" and the loading cylinders 7 enable the shoe press to accommodate motion of one loading cylinder relative to an adjacent loading cylinder in the cross-machine direction, such as may be caused by thermal expansion of the beam 4, while maintaining sealing connections between the duct members 9" and the loading cylinders.

The securing of the pistons 8 on the beam 4 is advantageously carried out in such a manner that the loading cylinders 6 can, if desired, be moved relative to the press shoe 1 in the machine direction for moving the center line C1 of the loading cylinder 6 relative to the center line C2 of the shoe press. More particularly, in the embodiment shown, the securing device consists of a suitable number of screws 16 and eccentric plates 18 on opposite sides of each piston 8 in the machine direction, and of a groove 19 formed in the piston on each piston side. The screws 16 extend through holes 18' in the plates 18 and are screwed in the beam 4, and the plates 18 engage the grooves 19 in the sides of the pistons 8 such that tightening the screws by the screw heads 16' causes the plates 18 to be clamped between the screw heads 16' and the beam 4, thereby fixedly securing the piston 7 on the beam 4.

The plates 18 preferably are identically polygonal and eccentric. The center line C1 of the loading cylinders 6 can thus be moved relative to the center line C2 of the shoe press, if desired, by loosening the screws 16 by their heads 16' and by rotating the plates around the screws 16 for allowing the desired movement of the loading cylinder 6 in the desired direction of movement (in the machine direction). If, for instance, the loading cylinder 6 is to be moved in the traveling direction of the web W, the left plate 18 is rotated such that an edge thereof positioned further away from the center axis of the screw 16 engages in the left groove 19, and the right plate 18 is rotated such that an edge thereof which is positioned correspondingly closer to the center axis of the screw 16 engages in the right groove 19.

The eccentric plates can be identical, or they can be of two types which are mirror images of each other. The circumferential part of the plates, which is not intended for engaging the grooves 19, can be circular.

In an alternative to eccentric plates, a single eccentrically flanged sectional rod or bar can be arranged on the respective sides of the loading cylinders, engaging in the grooves 19 of the pistons 8 by means of one flange and screwed in the beam 4 by means of another flange, in which case the desired movement of the loading cylinders can be effected by loosening the screws and rotating the rods about their longitudinal axes.

Figure 1A:
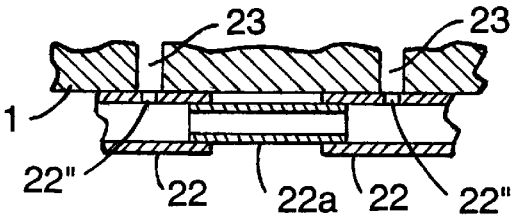
FIG. 1A is a cross-sectional view taken on the line 1A—1A of FIG. 1.
Figure 3:
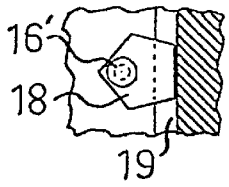
FIG. 3 is a cross-sectional view taken on line III—III of FIG. 1 showing an eccentric plate.

By arranging the common duct 9 for supplying the working chambers 10, the beam 4 is not weakened by a corresponding bore. This is also the purpose of the arrangement shown in FIG. 1 and FIG. 1A for supplying hydraulic fluid to one or more hydrostatic compartments 21 arranged in the side of the press shoe 1 facing the counter roll 2 for lubricating the press belt 3. The compartments 21 are supplied with hydraulic fluid by means of a pipe 22, whose hydraulic fluid conducting bore 22' is connected to each compartment by means of a duct 23 formed in the press shoe and a through hole 22" which is formed in the wall of the pipe 22 and which may be designed as a throttle. The pipe 22 is fixed to one side of the press shoe, in this case the upstream side, by means of pipe flanges 24 and screws 25. The pipe can be common to all compartments 21. Alternatively, a plurality of pipes 22 are attached to the press shoe and each pipe 22 supplies fluid to one compartment 21, in which case the separate pipes 22 communicate with each other via connecting pipes 22*a* similar to the duct members 9", thereby making it possible to absorb heat conditioned deformation forces applied to the pipe 22 (i.e., thermal expansion caused the shoe to expand in length in the cross-machine direction, and the pipes 22, 22*a* accommodate this longitudinal expansion by virtue of the slidable connections between the pipes).

Alternatively, the pipe 22 or the pipes 22 and the connecting pipes 22*a* can supply hydrostatic compartments 26 between the press shoe and the loading cylinders 6 via ducts 27 (indicated by dashed lines) formed in the press shoe. It will also be appreciated that the pipes 22, 22*a* can be arranged on the opposite longitudinal side edge (i.e., the downstream edge) of the press shoe rather than the upstream side edge.

The invention is also applicable to the supply of the working chambers of the loading cylinders 6 with hydraulic fluid through the cylinder 7 of the loading cylinders. In this instance, a pipe, or a plurality of pipes and connecting pipes as described above, are arranged as stated above on a longitudinal side edge of the press shoe, and the cylinders of the loading cylinders are formed as recesses in the press shoe, to which recesses the pipe or the pipes and connecting pipes are connected each by means of a bore formed in the press shoe and a hole formed in the pipe wall.

While the invention has been described in connection with a shoe press useful in a press section of a papermaking machine, it will be understood that the invention is also useful in a calender section of a papermaking machine.

Many modifications and other embodiments of the invention will come to mind to one skilled in the art to which this invention pertains having the benefit of the teachings presented in the foregoing description and accompanying drawings. Therefore, it is to be understood that the invention is not to be limited to the particular embodiments illustrated and described herein, and that modifications, substitutions of equivalents, and other embodiments are intended to be included within the scope of the appended claims. Although specific terms are employed herein, they are used in a generic and descriptive sense only and not for purposes of limitation.

That which is claimed is:

1. A shoe press for pressing a running fibrous web against a counter roll, comprising:

a press shoe having a first side structured and arranged to coact with the counter roll to form an extended nip therebetween through which the running web is carried;

a supporting frame spaced from a second side of the press shoe opposite the first side;

at least a pair of hydraulic loading cylinders disposed between the frame and the press shoe and operable for pressing the press shoe against the counter roll, each loading cylinder having a working chamber structured and arranged to be pressurized with hydraulic fluid, the loading cylinders being arranged in a row extending in a longitudinal direction of the press shoe; and at least one tubular duct member which is formed separately from the supporting frame and which is connected between and disposed between adjacent loading cylinders so as to form a common duct for supplying fluid to the working chambers of said adjacent loading cylinders.

2. The shoe press of claim 1, wherein each of the loading cylinders includes a receptacle in communication with the respective working chamber, and wherein opposite ends of each tubular duct member are received by the receptacles of the adjacent loading cylinders.

3. The shoe press of claim 2, wherein each loading cylinder includes a piston, and wherein the duct is formed in part by a bore through each of the pistons, each bore having opposite open ends forming the receptacles for receiving the ends of the tubular duct members.

4. The shoe press of claim 3, further comprising a passage formed in the piston of each loading cylinder, the passage connecting the working chamber of the loading cylinder to the bore in the piston.

5. The shoe press of claim 3, wherein the loading cylinders are spaced apart in a row extending in a cross-machine direction along the press shoe, the bores in the pistons extending in the cross-machine direction and each tubular duct member extending in the cross-machine direction between two adjacent loading cylinders.

6. The shoe press of claim 3, wherein opposite ends of each tubular duct member are slidably received in end portions of the piston bores of adjacent loading cylinders, and further comprising a sealing ring disposed between an outer surface of each tubular duct member and an inner surface of the end portion of the corresponding piston bore.

7. The shoe press of claim 1, wherein at least one of the tubular duct members includes an inlet structured and arranged to receive hydraulic fluid from a source for supplying hydraulic fluid to the common duct connecting the loading cylinders.

8. The shoe press of claim 7, wherein the tubular duct member having the inlet comprises a first tubular portion having opposite ends which connect with an adjacent pair of the loading cylinders, and a second tubular portion which is attached to and opens into the first tubular portion so as to form the inlet.

9. A shoe press for pressing a running fibrous web against a counter roll, comprising:

a press shoe having a first side structured and arranged to coact with the counter roll to form an extended nip therebetween through which the running web is carried;

a supporting frame spaced from a second side of the press shoe opposite the first side;

a plurality of hydraulic loading cylinders disposed between the frame and the press shoe and operable for pressing the press shoe against the counter roll, the loading cylinders being arranged in a row extending in a longitudinal direction of the press shoe;

a plurality of fluid-receiving compartments formed in at least one of the first and second sides of the press shoe and spaced apart in a cross-machine direction;

at least a pair of tubular duct members attached to a side of the press shoe and connected end-to-end with at least one end portion of at least one of the duct members being slidably received within a bore formed in an adjacent one of the duct members such that elongation of the press shoe caused by thermal expansion is accommodated by relative sliding between the duct members, at least some of the duct members including at least one opening through a side wall thereof; and a plurality of ducts formed in the press shoe, each duct having one end communicating with one of the openings in one of the duct members and an opposite end opening into one of the fluid-receiving compartments.

10. The shoe press of claim 9, wherein the tubular duct members comprise at least a pair of main pipes attached to a side of the press shoe and spaced apart from each other in a cross-machine direction, and at least one connecting pipe which is connected between adjacent main pipes, each of the main pipes including a bore therein and each connecting pipe having opposite ends slidably received in the bores of adjacent main pipes.

11. The shoe press of claim 10, wherein the openings which communicate with the ducts in the press shoe are formed in the main pipes.

12. The shoe press of claim 10, wherein the fluid-receiving compartments comprise hydrostatic compartments formed in the first side of the press shoe which faces the counter roll.

13. The shoe press of claim 10, wherein the fluid-receiving compartments comprise pressure chambers formed between the second side of the press shoe and the loading cylinders.

* * * * *